US009943149B2

(12) United States Patent
Murphy

(10) Patent No.: US 9,943,149 B2
(45) Date of Patent: Apr. 17, 2018

(54) CARRYING CASES

(75) Inventor: Kevin Murphy, Hermosa Beach, CA (US)

(73) Assignee: Pelican Products, Inc., Torrance, CA (US)

( * ) Notice: Subject to any disclaimer, the term of this patent is extended or adjusted under 35 U.S.C. 154(b) by 420 days.

(21) Appl. No.: 13/403,682

(22) Filed: Feb. 23, 2012

(65) Prior Publication Data

US 2013/0221050 A1 Aug. 29, 2013

(51) Int. Cl.

| | |
|---|---|
| ***A45F 3/04*** | (2006.01) |
| ***A45C 5/06*** | (2006.01) |
| *A45C 5/03* | (2006.01) |
| *A45C 13/02* | (2006.01) |

(52) U.S. Cl.

CPC ..... *A45C 5/06* (2013.01); *A45F 3/047* (2013.01); *A45C 2005/037* (2013.01); *A45C 2013/025* (2013.01); *A45C 2013/026* (2013.01); *Y10T 29/49* (2015.01); *Y10T 29/49826* (2015.01)

(58) Field of Classification Search

CPC ..... A45C 5/06; A45C 2005/037; A45C 2013/026; A45F 3/047; Y10T 29/49

USPC .... 224/261–263, 637, 148.7, 628, 629, 678, 224/679, 246, 271, 272, 607, 218, 653; 220/500, 521, 523

See application file for complete search history.

(56) References Cited

U.S. PATENT DOCUMENTS

| | | | | |
|---|---|---|---|---|
| 2,813,602 A * | 11/1957 | MacArthur, Jr. | ..... | 224/220 |
| 3,410,376 A * | 11/1968 | Benzel | ..... | 190/110 |
| 3,837,447 A * | 9/1974 | Honan | ..... | 190/110 |
| 4,206,835 A * | 6/1980 | Shapiro | ..... | 190/108 |
| 4,921,151 A * | 5/1990 | Duvall | ..... | 224/438 |
| 5,547,052 A * | 8/1996 | Latshaw | ..... | A45C 5/14 16/113.1 |
| 5,562,236 A * | 10/1996 | Monzingo | ..... | 224/153 |
| 5,706,992 A * | 1/1998 | Moor | ..... | G06F 1/1628 190/102 |
| 6,109,402 A * | 8/2000 | Godshaw | ..... | A45C 5/14 150/113 |
| 7,681,769 B2 * | 3/2010 | Kramer | ..... | A45F 3/08 224/581 |
| 2003/0015559 A1 * | 1/2003 | Oh | ..... | A45C 5/14 224/153 |
| 2005/0017041 A1 * | 1/2005 | Roberts | ..... | 224/642 |

(Continued)

FOREIGN PATENT DOCUMENTS

| | | |
|---|---|---|
| DE | 82 30 661 | 4/1984 |
| DE | 195 31 362 | 2/1997 |

(Continued)

OTHER PUBLICATIONS

JP 2002345525 A Translation.*

(Continued)

*Primary Examiner* — Justin Larson
*Assistant Examiner* — Matthew Theis
(74) *Attorney, Agent, or Firm* — Foley & Lardner LLP

(57) ABSTRACT

A carrying case includes a first compartment made of a rigid material, the first compartment defining an interior volume; and a second compartment coupled to the first compartment, the second compartment made of a flexible material, the second compartment defining an interior volume that is separate from the interior volume of the first compartment.

10 Claims, 15 Drawing Sheets

(56) References Cited

U.S. PATENT DOCUMENTS

| | | | | |
|---|---|---|---|---|
| 2006/0243550 | A1 | 11/2006 | Morszeck | |
| 2007/0051765 | A1* | 3/2007 | Hsieh | 224/576 |
| 2009/0127299 | A1 | 5/2009 | Jamlang | |
| 2011/0186611 | A1* | 8/2011 | Eberle | A45F 3/04 224/583 |
| 2011/0204114 | A1 | 8/2011 | Miller | |

FOREIGN PATENT DOCUMENTS

| | | | | |
|---|---|---|---|---|
| DE | 19531362 | A1 * | 2/1997 | 224/673 |
| JP | 3168633 | | 7/1991 | |
| JP | 2002-345525 | | 12/2002 | |
| JP | 2002345525 | A * | 12/2002 | 224/673 |
| JP | 2011-204114 | | 10/2011 | |
| WO | WO-00/21400 | | 4/2000 | |

OTHER PUBLICATIONS

DE 19531362 A1 Translation.*

Australian Examiner's Report dated Feb. 21, 2014, from related Australian patent application No. 2013201103.

Japanese Office Action dated Mar. 13, 2014, from related Japanese patent application No. 2013034670.

Canadian Examiner's Report, dated Feb. 4, 2014, from related Canadian Patent Application No. 2,805,790.

European Search Report, dated Jul. 9, 2013, from related European Patent Appln No. 13156359.5.

Canadian Examiners Report, dated Sep. 19, 2014, from related Canadian Patent Application No. 2,805,790.

Chinese Office Action dated Aug. 8, 2014, from related Chinese patent application No. 201310055287.3.

Japanese Office Action dated Jan. 6, 2015, from related Japanese patent application No. 2013-034670.

Canadian Office Action dated Apr. 9, 2016, from related Canadian patent application No. 2,805,790.

Chinese Office Action dated Mar. 17, 2015, from related Chinese patent application No. 201310055287.3.

Canadian Examiner's Report dated Feb. 17, 2016, from related CA Application No. 2,805,790.

European Office Action dated Mar. 3, 2017, from related application No. 13156359.5.

Examiner's Report dated Oct. 27, 2016, from related Canadian application No. 2,805,790.

Canadian Examiner's Report dated May 29, 2017, from application No. 2,805,790.

European Office Action dated Oct. 6, 2017, from application No. 13156359.5.

* cited by examiner

FIG. 10A
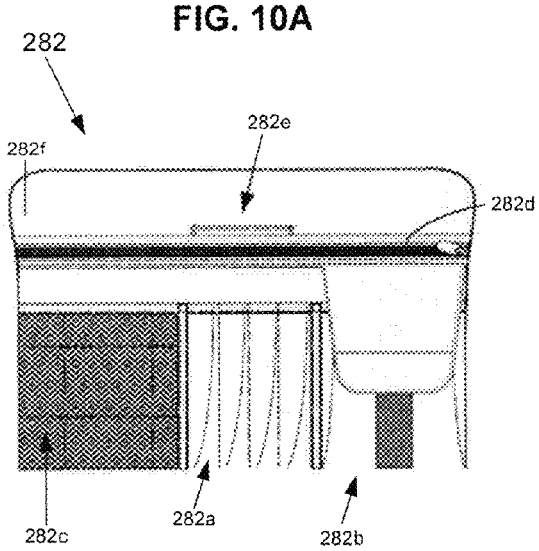
FIG. 10B
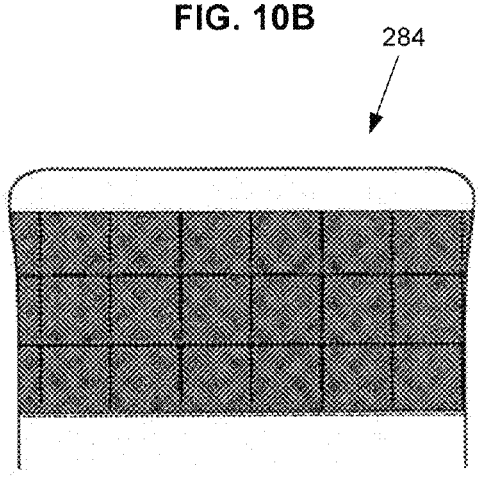
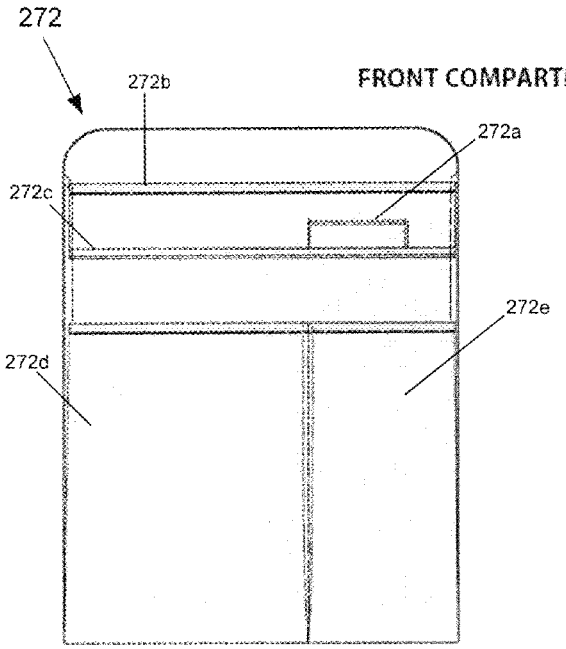
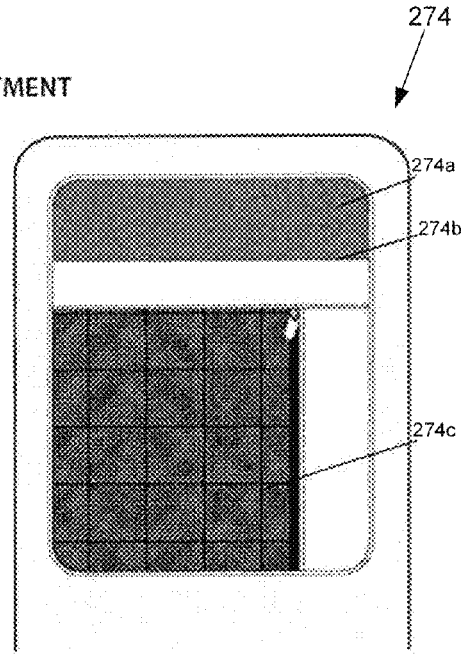
FIG. 10C
FIG. 10D

CARRYING CASES

FIELD OF THE DISCLOSURE

Various embodiments generally relate to the field of carrying cases and in specific embodiments to backpack carrying cases.

SUMMARY OF THE DISCLOSURE

A carrying case includes (but is not limited to) a first compartment and a second compartment. The first compartment is made of a rigid material. The first compartment defines an interior volume. The second compartment is coupled to the first compartment. The second compartment is made of a flexible material. The second compartment defines an interior volume that is separate from the interior volume of the first compartment.

In various embodiments, the first compartment includes a first shell member and a second shell member. The first shell member and the second shell member define the interior volume of the first compartment. The first shell member is arranged for movement relative to the second shell member to provide access to the interior volume.

In some embodiments, the second compartment is coupled to one of the first shell member and the second shell member. In further embodiments, the carrying case includes a support member to which the second compartment and the one of the first shell member and the second shell member are affixed. In yet further embodiments, the support member is arranged in the interior volume of the second compartment. In yet further embodiments, the support member comprises a frame. In yet further embodiments, the support member comprises at least one of a group of bars, grommets, and pan-head screws.

In some embodiments, the second compartment includes a front shell coupled to the one of the first shell member and the second shell member and a rear shell coupled to the other of the one of the first shell member and the second shell member. In further embodiments, the carrying case includes a support member to which the rear shell of the second compartment and the other of the first shell member and the second shell member are affixed. In yet further embodiments, the support member is arranged in an interior volume defined by the rear shell of the second compartment. In yet further embodiments, the support member comprises a frame. In yet further embodiments, the rear shell of the second compartment has one or more connecting members coupled to one or more of the support member, the other of the first shell member and the second shell member, and the one of the first shell member and the second shell member. In further embodiments, the connecting members comprise one or more of straps and handles. In further embodiments, the connecting members are coupled to the one or more of the support member and the other of the first shell member and the second shell member at a position substantially corresponding to a center of the other of the first shell member and the second shell member.

In further embodiments, the first shell member and the second shell member are arranged between the rear shell of the second compartment and the front shell of the second compartment. In further embodiments, the rear shell comprises a lumbar support coupled to the first compartment and one or more shoulder straps coupled to the first compartment for carrying the carrying case. In further embodiments, the front shell includes a plurality of compartments.

In various embodiments, one or more of the first shell member and the second shell member are configured to seal the interior volume of the first compartment when the first shell member and the second shell member are closed together.

In various embodiments, the carrying case further includes a hinge member for providing movement of the first shell member relative to the second shell member.

In various embodiments, the second compartment comprises a plurality of compartments.

In various embodiments, the carrying case is configured as a backpack.

In various embodiments, the carrying case includes one or more shoulder straps and a lumbar support. The one or more shoulder straps are coupled to the first compartment for carrying the carrying case. The lumbar support is coupled to the first compartment.

In various embodiments, the carrying case includes one or more shoulder straps coupled to the first compartment for carrying the carrying case.

A method of manufacturing a carrying case includes (but is not limited to) any one or combination of: (i) providing a first compartment made of a rigid material, the first compartment defining an interior volume; and (ii) providing a second compartment coupled to the first compartment, the second compartment made of a flexible material, the second compartment defining an interior volume that is separate from the interior volume of the first compartment.

A method of manufacturing a carrying case includes (but is not limited to) any one or combination of: (i) providing a rear soft shell and a front soft shell; (ii) coupling the rear soft shell to a rear half of a hard shell; (iii) coupling the front soft shell to a front half of the hard shell; and (iv) coupling the front half of the hard shell to the rear half of the hard shell.

In various embodiments, coupling the rear soft shell to a rear half of a hard shell includes: providing a support member; and affixing the rear soft shell to the support member; and affixing the rear half of the hard shell to the support member.

BRIEF DESCRIPTION OF THE DRAWINGS

FIGS. 10A-10F illustrate various components of a backpack according to various embodiments of the disclosure.

DETAILED DESCRIPTION

Figure 2:
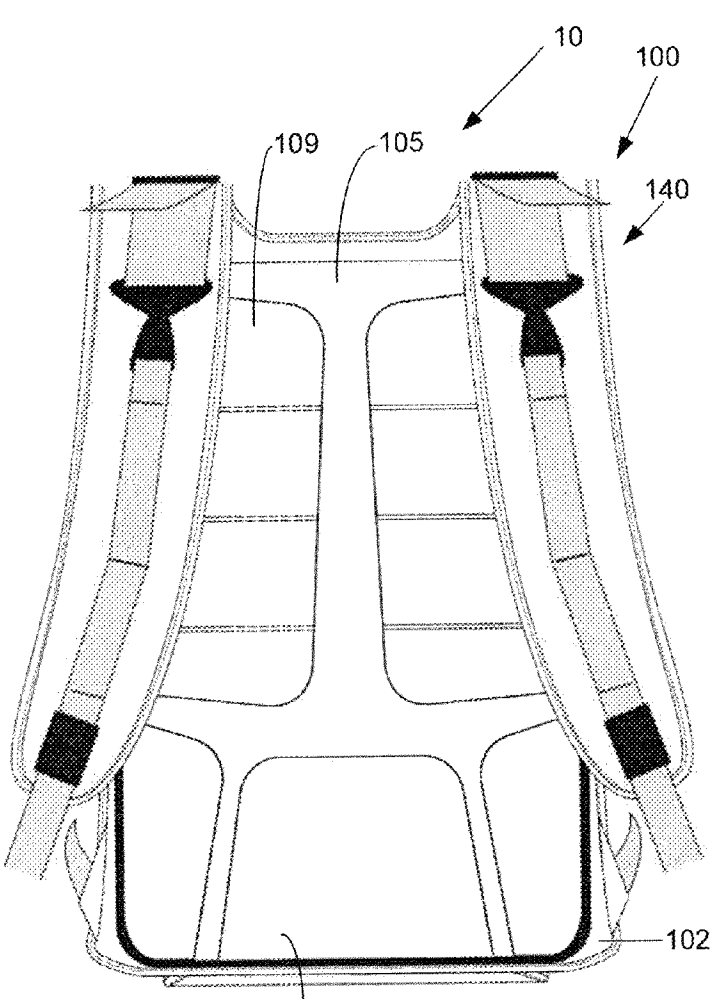
FIGS. 1-9B illustrate various views of a backpack according to various embodiments of the disclosure.
Figure 1:
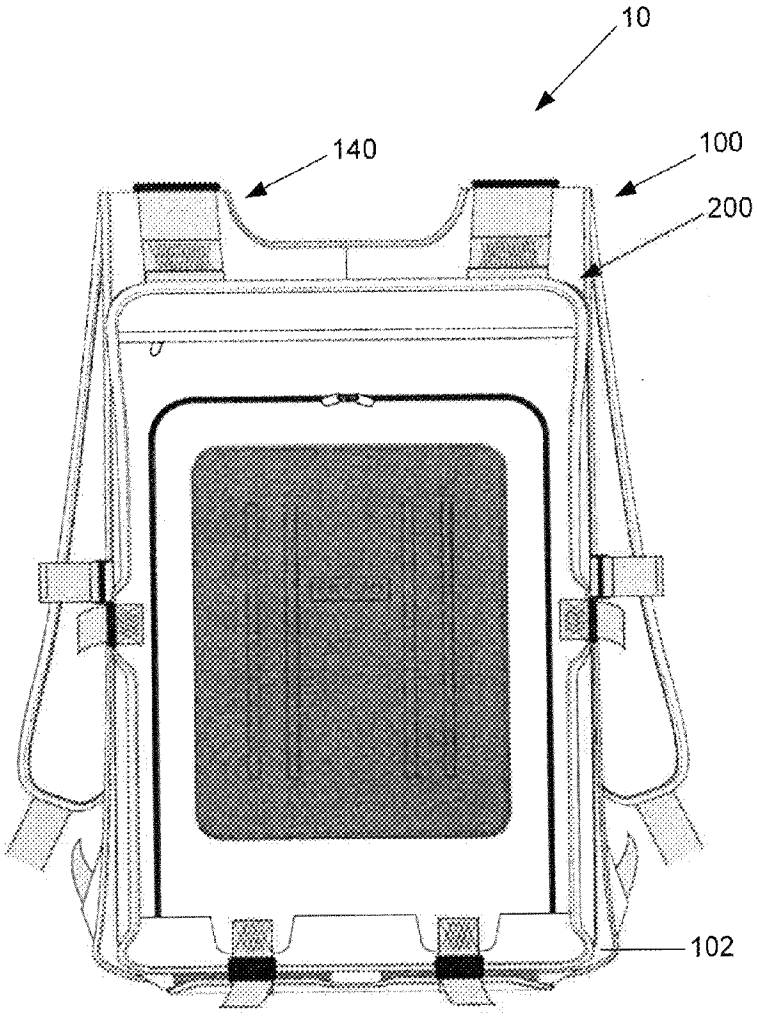
Figure 4:
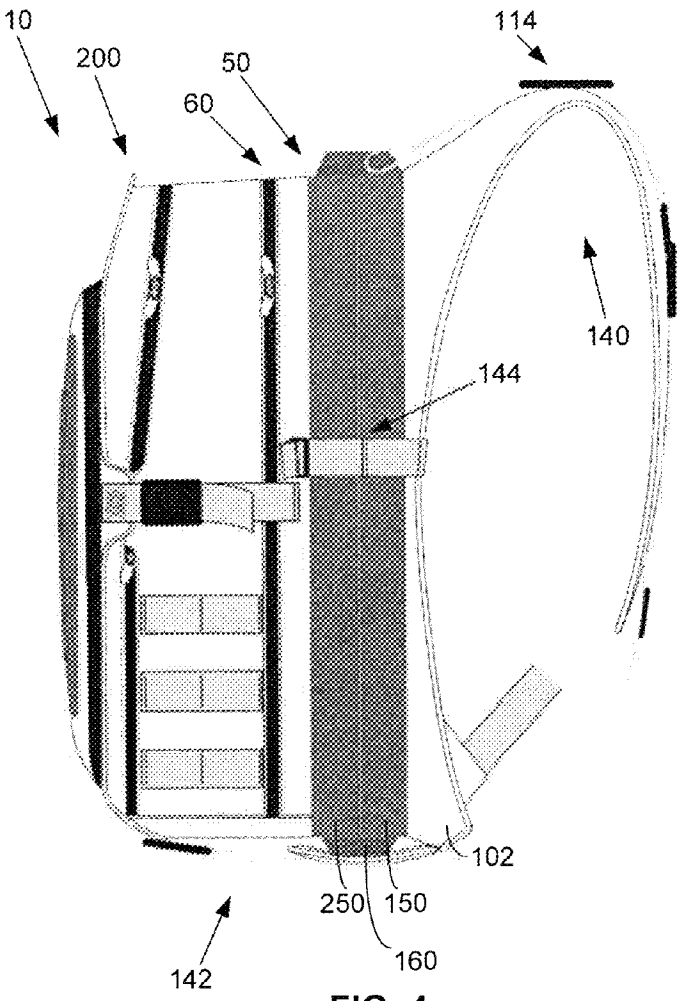
Figure 3:
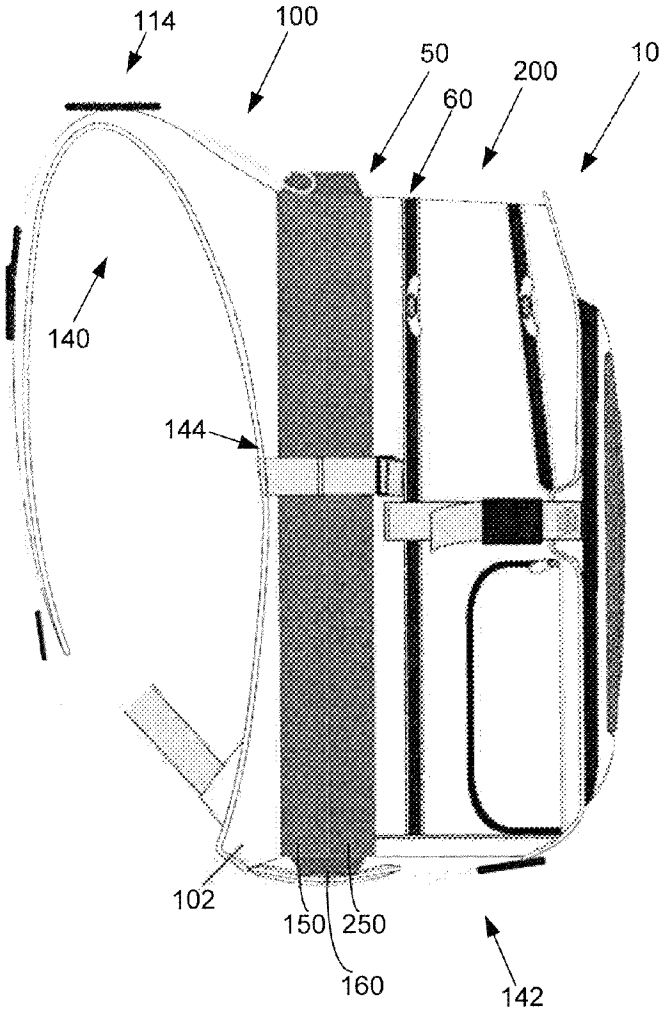
Figure 6:
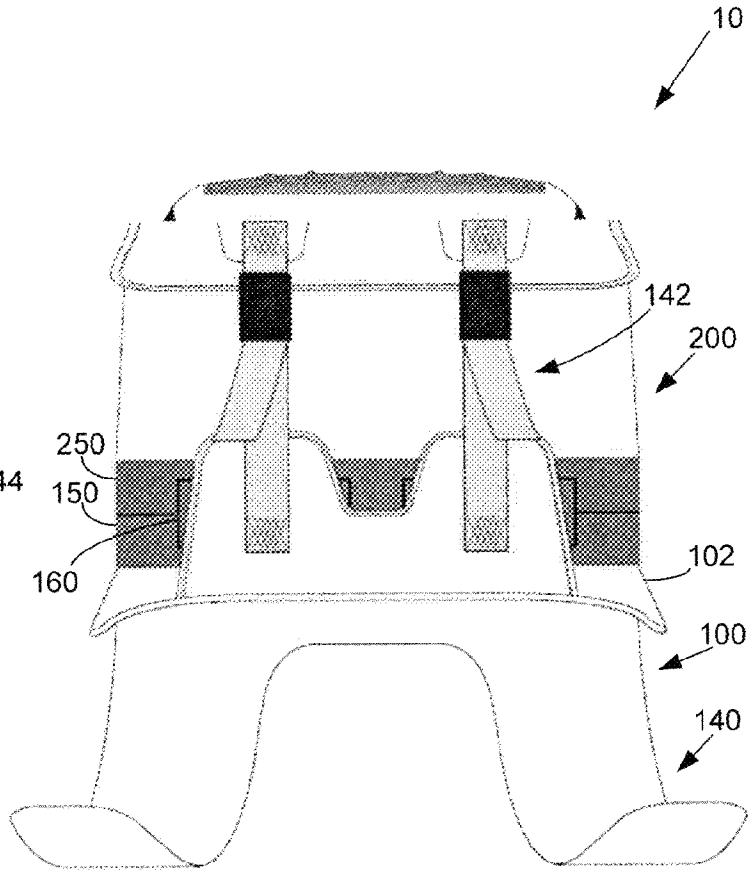
Figure 5:
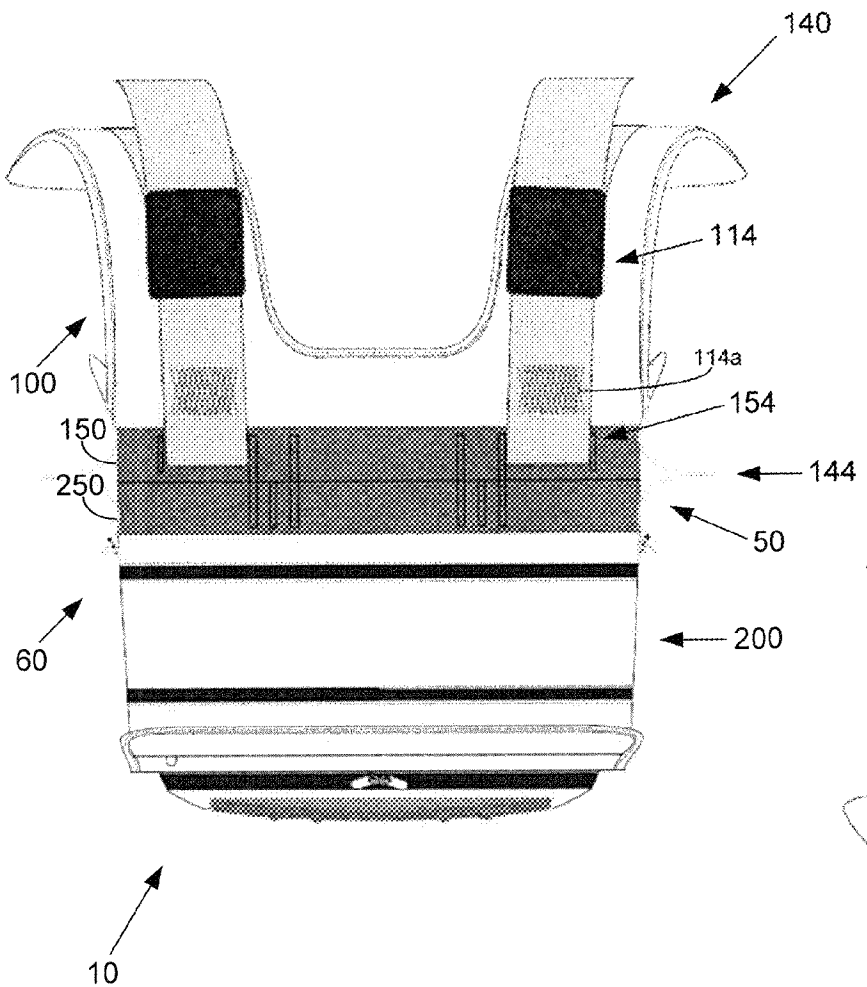
Figure 7B:
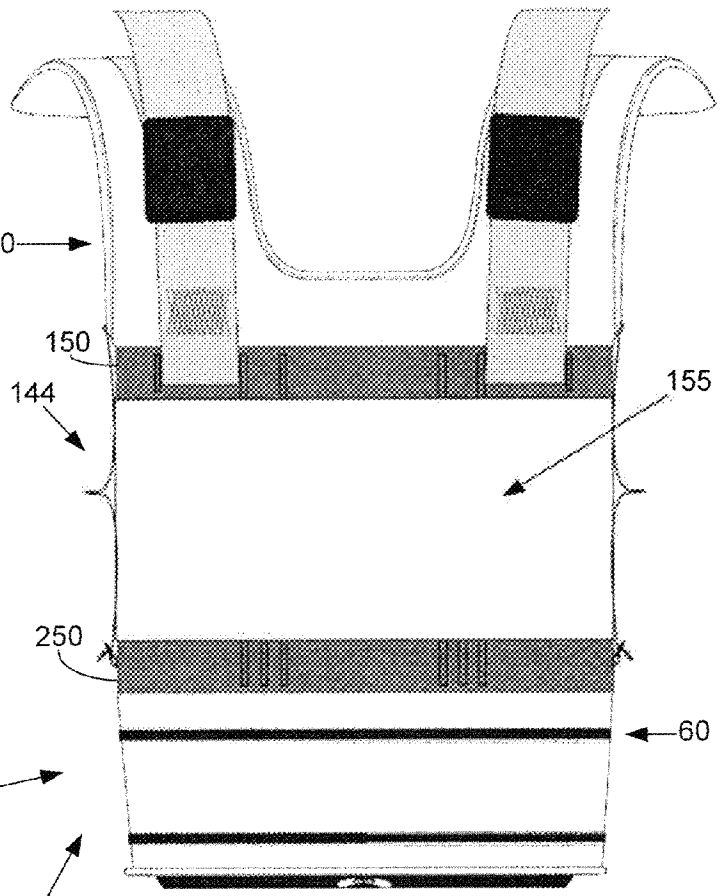
Figure 7A:
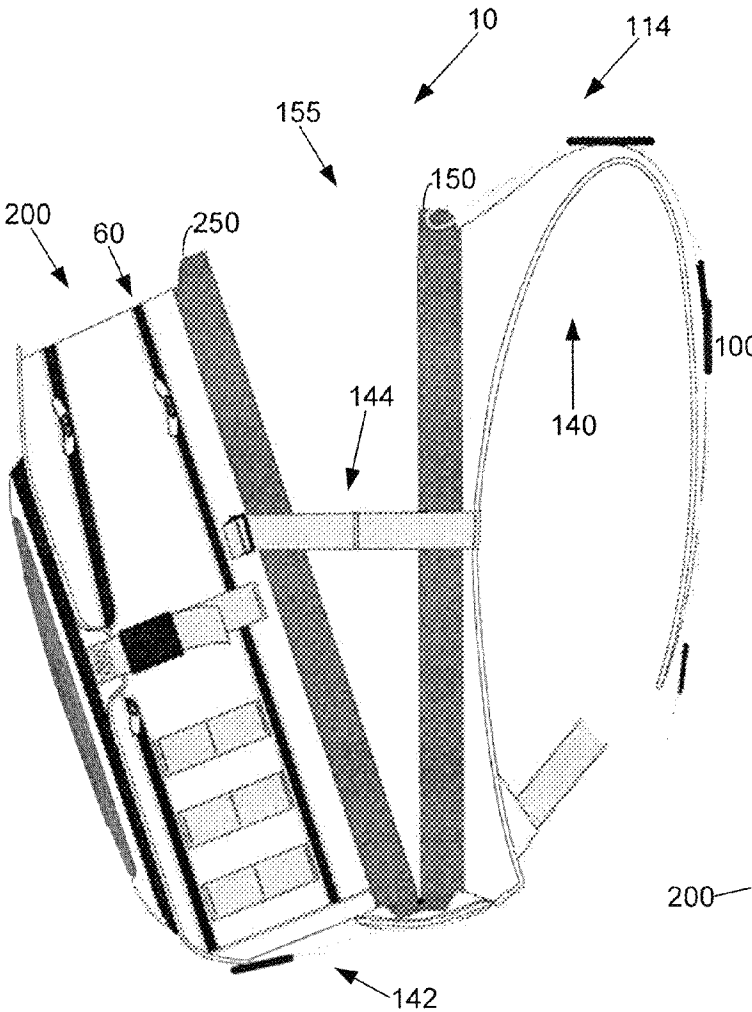
Figure 8B:
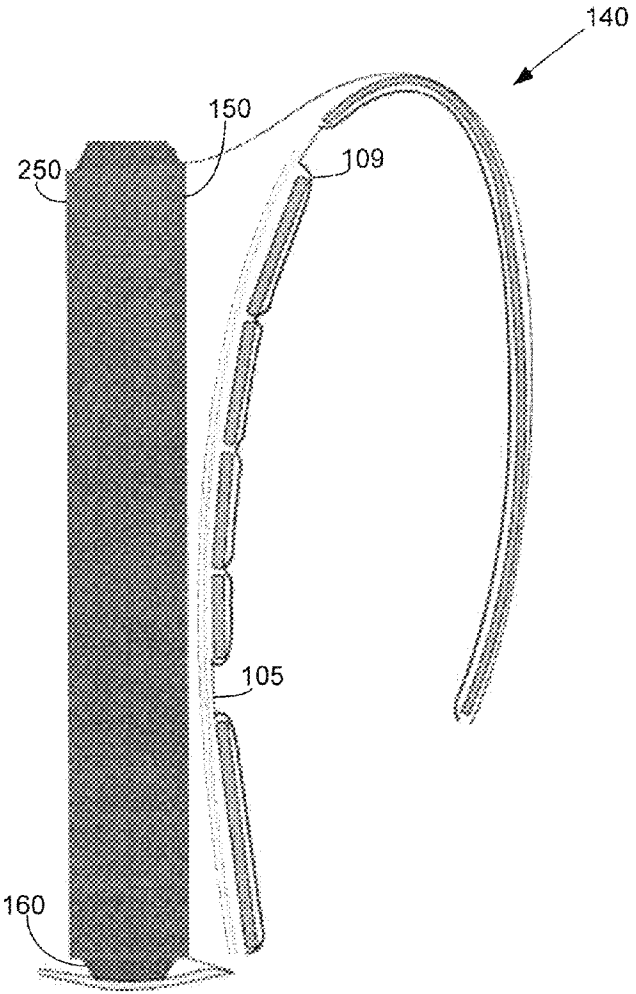
Figure 8A:
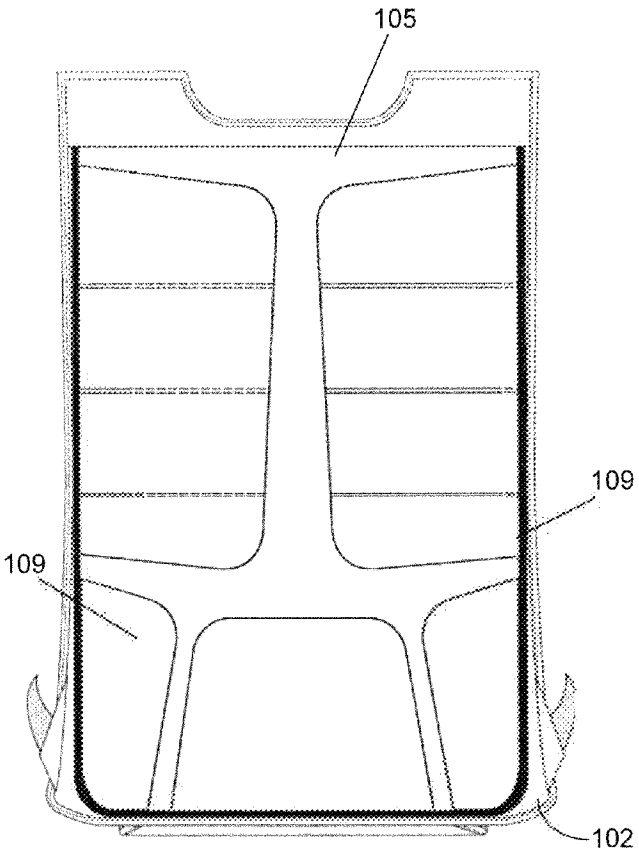

Various embodiments relate to carrying cases that combine one or more rigid (and/or sealed) compartments and one or more soft (e.g., fabric) compartments. The rigid compartments provide more protection (e.g., versus water, dust, impact, and/or the like) than the soft compartments.

With reference to FIGS. 1-11G, according to various embodiments, a backpack 10 includes a first compartment 50 and a second compartment 60. The first compartment 50 is made of a generally rigid material, such as but not limited to plastic, resins, rubber, metal, and/or the like. The first compartment 50 includes an interior volume 55 for storing one or more items (e.g., laptop, tablets, cameras, electronics, etc.).

The first compartment 50 includes a rigid rear shell 150 and a rigid front shell 250 that are arranged for movement relative to each other to provide access to the interior volume 55 of the first compartment 50. The rigid rear shell 150 and the rigid front shell 250 of the first compartment 50 are configured to protect (e.g., from water, dust, impact, and/or the like) the items placed in the interior volume 55.

In various embodiments, the first compartment 50 may be configured to provide one or more of water, dust, and impact protection. In specific embodiments, the first compartment 50 may configured to seal the interior volume 55. For example a seal member (not shown), such as an O-ring or the like, may be arranged on one or more of the rigid rear shell 150 and the rigid front shell 250 to provide a seal when the rigid rear shell 150 and the rigid front shell 250 are closed together.

The second compartment 60 is made of a flexible material (or a material less rigid than the first compartment 50), such as but not limited to fabric, cloth, canvas, mesh, and/or the like. The second compartment 60 includes an interior volume 65 for storing one or more items. In various embodiments, the interior volume 55 of the first compartment 50 is separate and inaccessible from the second interior volume 65 of the second compartment 60.

Figures 11A, 11B, 11C:
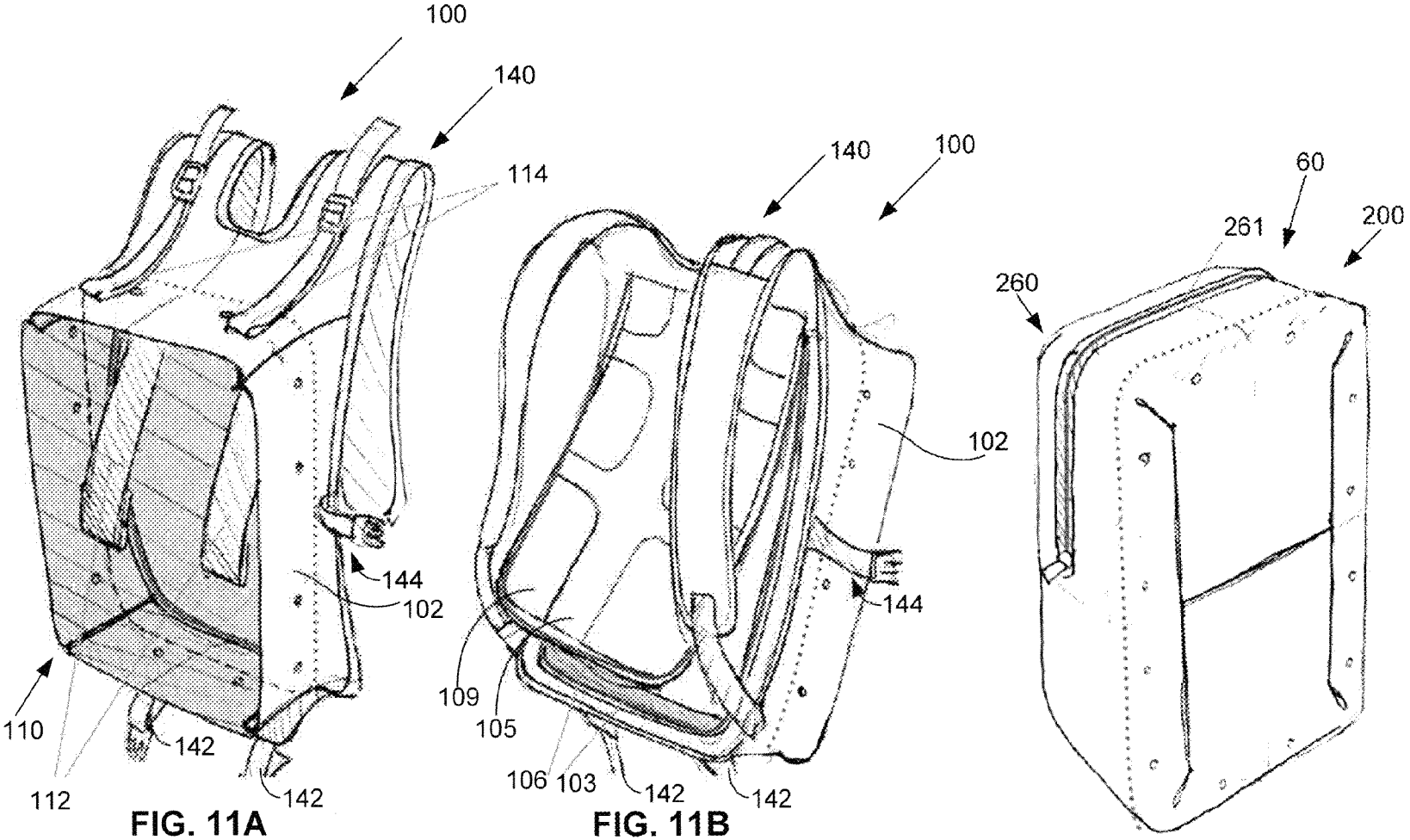
FIGS. 11A and 11B illustrate a rear soft shell of a backpack according to various embodiments of the disclosure.
FIG. 11C illustrates a front soft shell of a backpack according to various embodiments of the disclosure.

The backpack 10 includes a soft rear shell 100 (e.g., FIGS. 11A-11B) and a soft front shell 200 (e.g., FIG. 11C). The soft front shell 200 may correspond to the second compartment 60. In various embodiments, the rigid rear shell 150 and the rigid front shell 250 are arranged between the soft rear shell 100 and the soft front shell 200. The soft rear shell 100 includes a wall 102 that defines a recess 110. The recess 110 receives at least a portion of the rigid rear shell 150. In various embodiments, the soft rear shell 100 includes or is coupled to one or more shoulder straps 140. In various embodiments, the backpack 10 may include other support members for facilitating carrying or movement of the backpack 10, such as, but not limited to, wheels, hip belts, neck straps, handles, a harness, and/or the like.

Figure 11E:
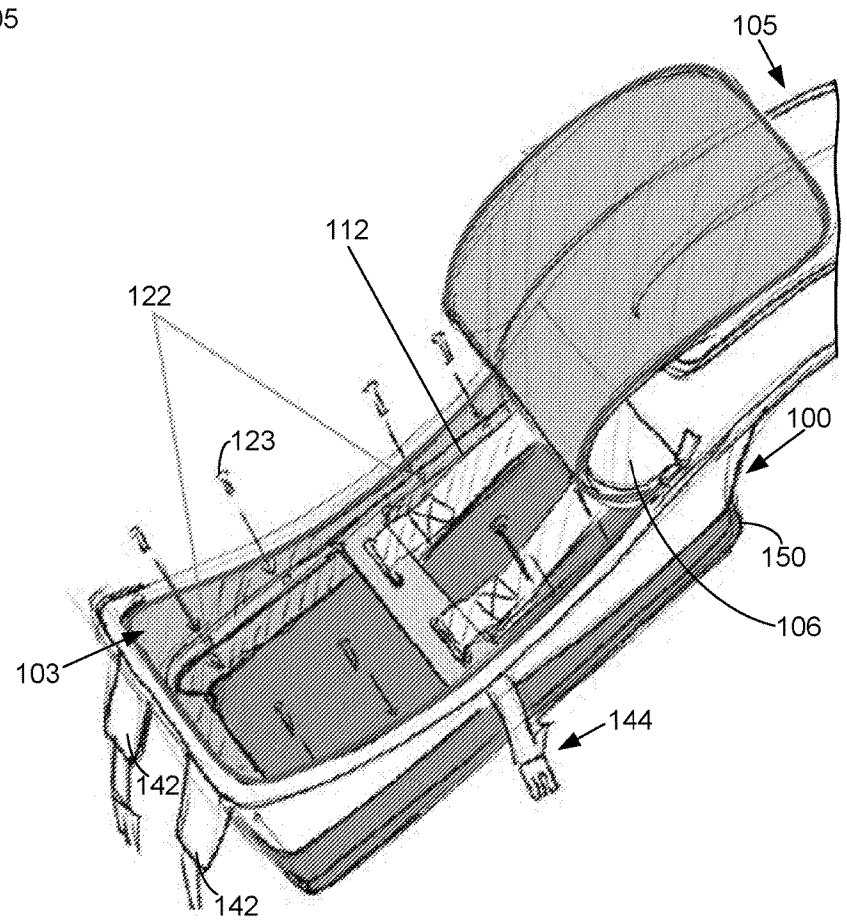
FIGS. 11D and 11E illustrate a rear soft shell and a rear rigid shell of a backpack according to various embodiments of the disclosure.
Figure 11D:
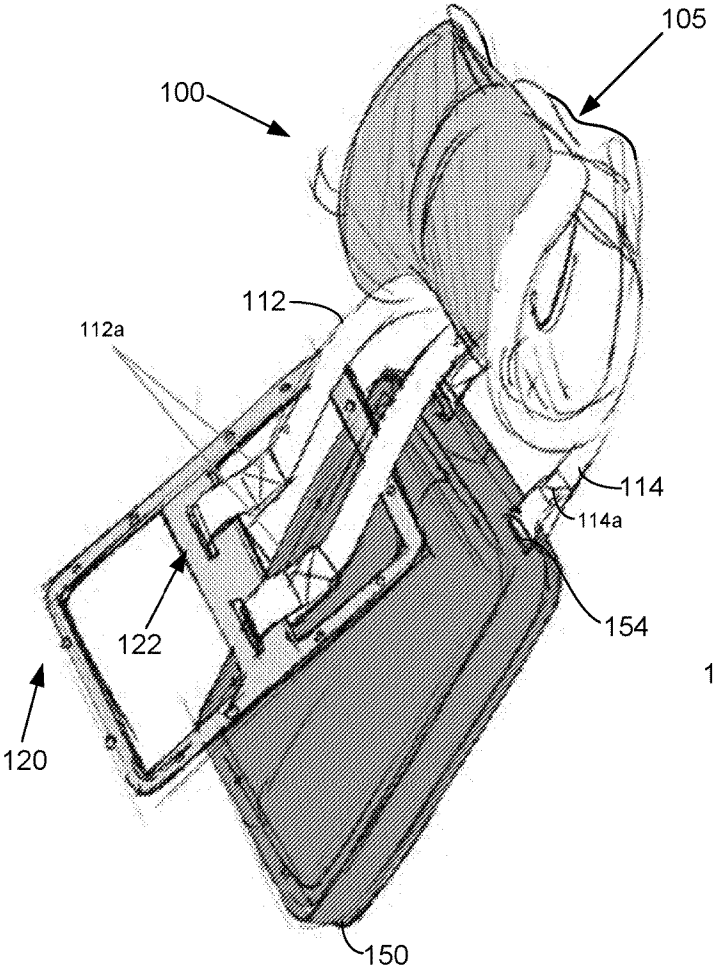
Figure 11G:
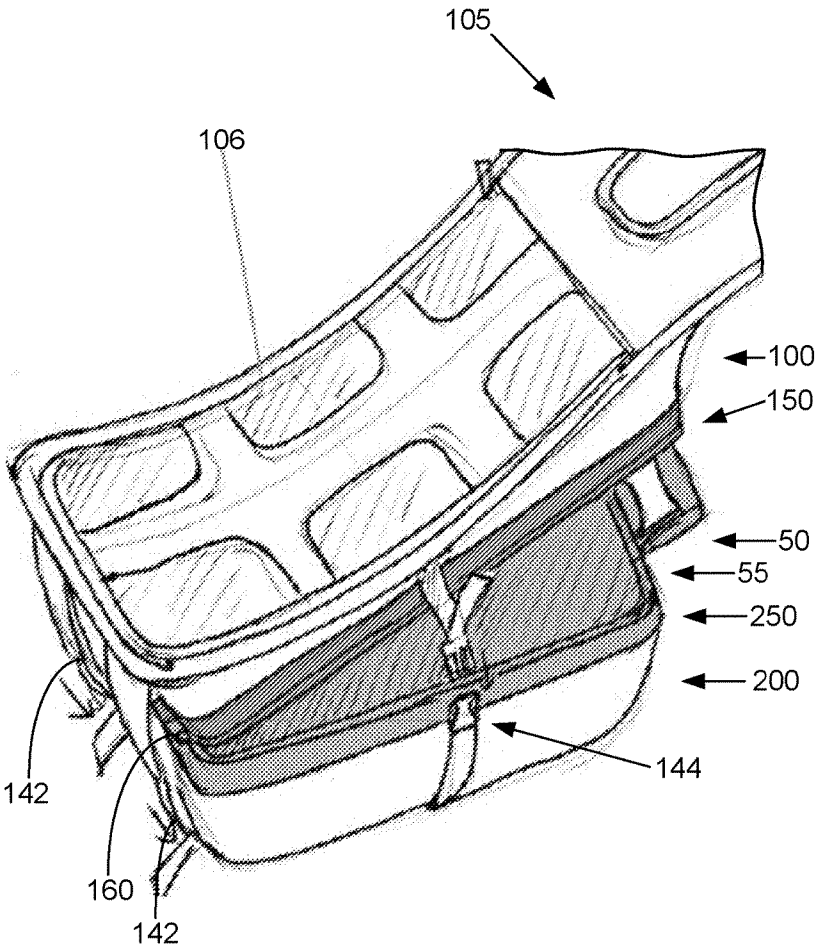
FIG. 11G illustrates a backpack according to various embodiments of the disclosure.

As shown, for example, in FIGS. 11D and 11E, the soft rear shell 100 is coupled to the rigid rear shell 150. In some embodiments, the soft rear shell 100 includes connecting members, such as support straps 114 or handles (or the like), which are external the recess 110, for attaching or otherwise fastening to the rigid rear shell 150. The external support straps 114 may be box stitched (114*a*), screwed, or otherwise fastened to a portion 154 of the rigid rear shell 150 (e.g., side of the rigid rear shell 150).

In some embodiments, the soft rear shell 100 includes connecting members, such as support straps 112 or handles (or the like), which are arranged within the recess 110, for coupling to the rigid rear shell 150. In particular embodiments, a rear surface 152 of the rigid rear shell 150 may be coupled to a support member, such as a frame 120 (e.g., H-bar frame). The internal support straps 112 may be box stitched (112*a*), screwed, or otherwise fastened to a coupling portion 122 of the frame 120 (e.g., center of the frame 120, side of the frame 120, etc.). The frame 120 is coupled to the soft rear shell 100 and/or the rigid rear shell 150 in any suitable manner including (but not limited to) via screws 123 or other fasteners and/or the like. In particular embodiments, the screws 123 may be arranged in apertures 124 of the frame 120 for receiving the screws 123.

By coupling the internal support straps to a coupling point (e.g., corresponding to the coupling portion 122 of the frame 120) of the rigid rear shell 150 (e.g., center of the rigid rear shell 150), a user carrying the backpack 10 is provided additional range of motion (e.g., to bend over in a direction away from the rigid rear shell 150) as the load is transferred to the coupling point of the rigid rear shell 150 and the user's back. In effect, a pivoting action is provided that allows the rigid rear shell 150 to tilt with the user. In some embodiments, the external support members 114 can be adjusted to change the load, for example to hold the load tighter to the user's back.

In various embodiments, the frame 120 may comprise a group of straight bars. In yet other embodiments, grommets, pan-head screws, or other support member may be used in place of (or in addition to) the frame 120. In such embodiments, for instance, the internal support straps 112 may be fastened to the straight bars, grommets, pan-head screws, or the like. In some embodiments, the internal support straps 112 are connected directly to the rigid rear shell 150. It should be noted that in other embodiments, the support straps 112 and/or the support straps 114 may be connected to any suitable component for assembling the backpack 10.

In some embodiments, the soft rear shell 100 may include a hatch 106 for provide an opening 103 for providing access to the frame 120 and the rear surface 152 of the rigid rear shell 150. After the soft rear shell 100 is coupled to the frame 120, the hatch 106 may be closed.

Figure 11F:
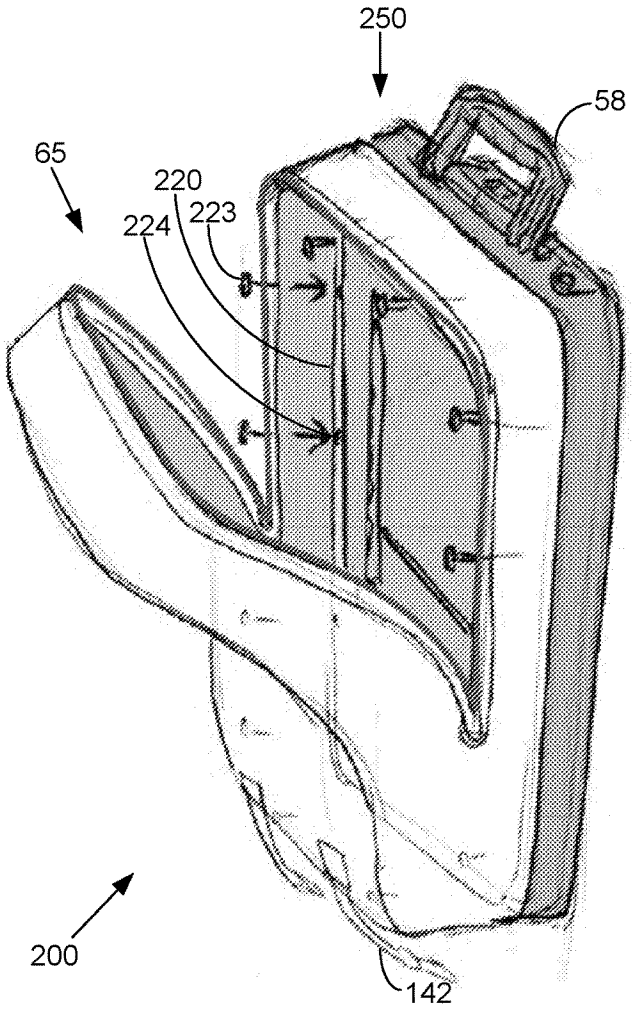
FIG. 11F illustrates a front soft shell and a front rigid shell of a backpack according to various embodiments of the disclosure.

As shown in FIG. 11F, the soft front shell 200 is coupled to the rigid front shell 250. In particular embodiments, a support member, such as a frame 220 is provided in the interior volume 65 of the soft front shell 200 for coupling the soft front shell 200 and the rigid front shell 250. The frame 220 is coupled to the soft front shell 200 and/or the rigid front shell 250 in any suitable manner including (but not limited to) via screws 223 or other fasteners and/or the like. In particular embodiments, the screws 223 may be arranged in apertures 224 of the frame 220 for receiving the screws 223. In other embodiments, the frame 220 may comprise a group of straight bars. In yet other embodiments, grommets, pan-head screws, or other support member may be used in place of (or in addition to) the frame 220.

As shown in FIG. 12G, the soft rear shell 100 is coupled to the soft front shell 200 and the rigid rear shell 150 is coupled to the rigid front shell 250. In particular embodiments, a hinge 160 is provided to couple the rigid rear shell and the rigid front shell 250. In some embodiments, one or more side strap 144 may be used to couple the soft rear shell 100 with the soft front shell 200, for example using a buckle and/or the like. The side strap 144 may also provide for side compression of the backpack 10. In some embodiments, one or more bottom straps 142 may be used to couple the soft rear shell 100 with the soft front shell 200, for example using a buckle and/or the like.

In some embodiments, a rear surface 105 of the soft rear shell 100 may include a lumbar support 109 (e.g., padding) or the like for user comfort while carrying the backpack 10. In particular embodiments, the hatch 106 for allowing access to the frame 120 may be provided under the rear surface 105.

Figure 15B:
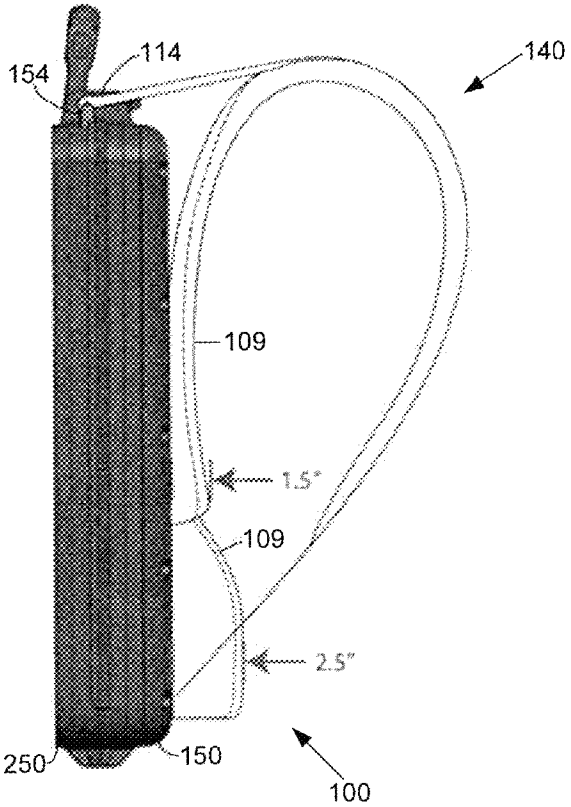
FIG. 15B illustrates a portion of a backpack according to various embodiments of the disclosure.
Figure 15A:
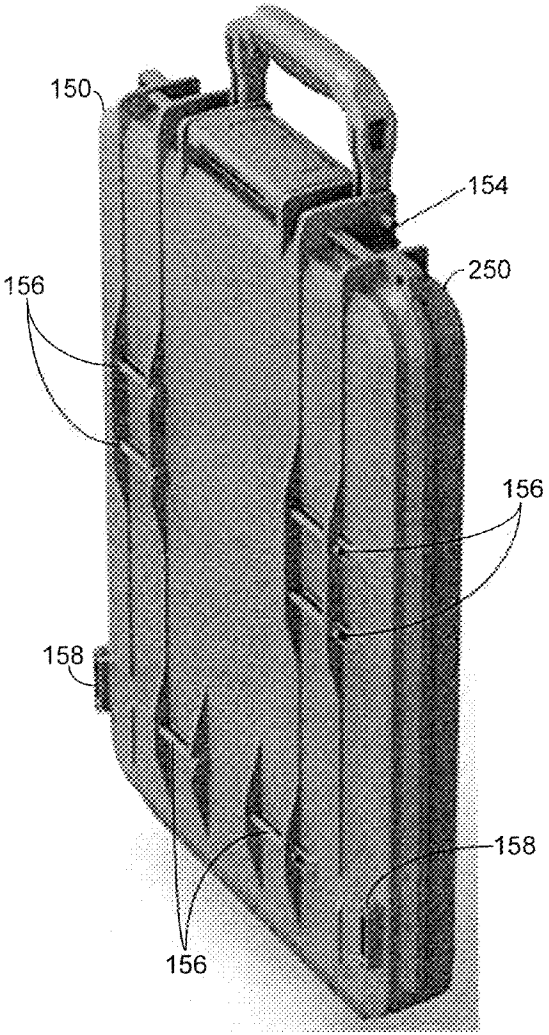
FIG. 15A illustrates a portion of a backpack according to various embodiments of the disclosure.

In some embodiments, the rigid rear shell 150 is coupled to the soft rear shell 100 via the frame 120 or the like. In such embodiments, for example, the soft rear shell 100 may enclose or otherwise cover a rear surface of the rigid rear shell 150. In other embodiments, for example, as shown in FIGS. 15A-15B, the rigid rear shell 150 is directly connected to the rear surface 105 of the soft rear shell 100. In some embodiments, the soft rear shell 100 comprises the lumbar support 109 and the shoulder straps 140. The lumbar support 109 and the shoulder straps 140 may be mounted directly to the rigid rear shell 150, for example, with fasteners (not shown), such as pins (not shown) or the like. For instance, the lumbar support 109 may be secured to the rigid rear shell 150 at fastening points 156 of the rigid rear shell 150 with the fasteners. The shoulder straps 140, which may attached to or part of the lumbar support 109, may be secured to the rigid rear shell 150, for example, via connection between the support straps 114 and the portion 154 of the rigid rear shell 150. The shoulder straps 140 may also be attached to the rigid rear shell 150 at fastening points 158. For instance, the fastening point 158 may be a boss for receiving a screw or other fastener. Or for instance, the fastening point 158 may be a pass-through slot for receiving an end of the shoulder strap 140. After the end of the shoulder strap 140 is inserted through the pass-through slot, the end of the shoulder strap 140 may be sewed or otherwise configured to prevent the end of the should strap 140 from coming out the pass-through slot.

With reference to FIGS. 1-11G and 15A-15B, in various embodiments, the first compartment 50 may include a handle 58. In some embodiments, the second compartment 60 may include a handle (not shown). In some embodiments, the backpack 10 may include wheels (not shown) for moving the backpack 10, for example, by pulling on an extendible handle (not shown) or the like.

Figure 9B:
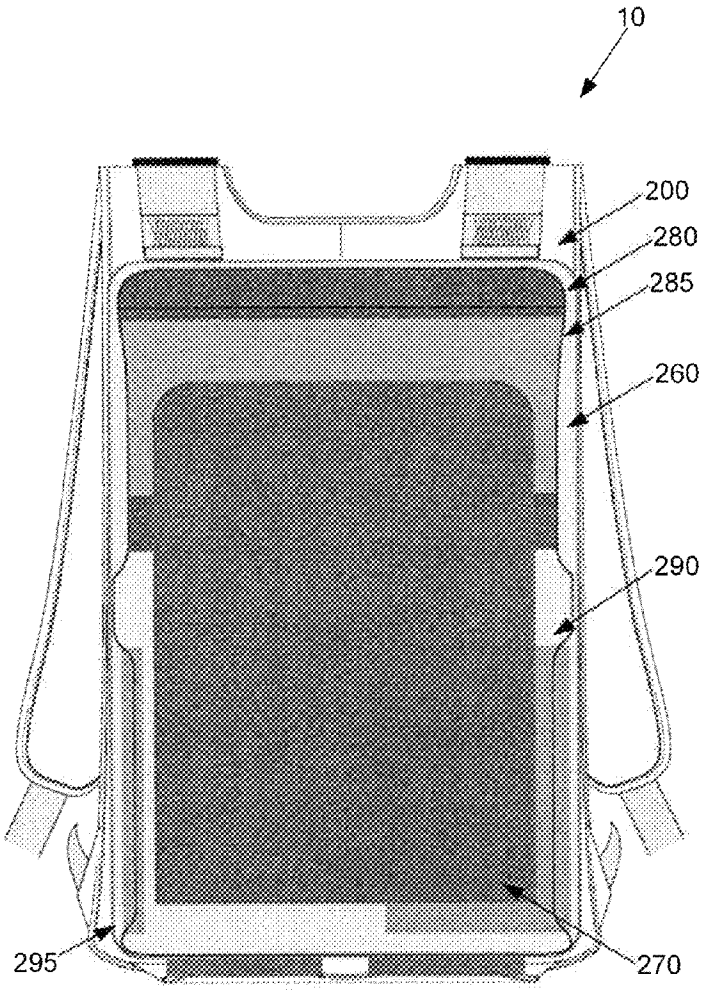
Figure 9A:
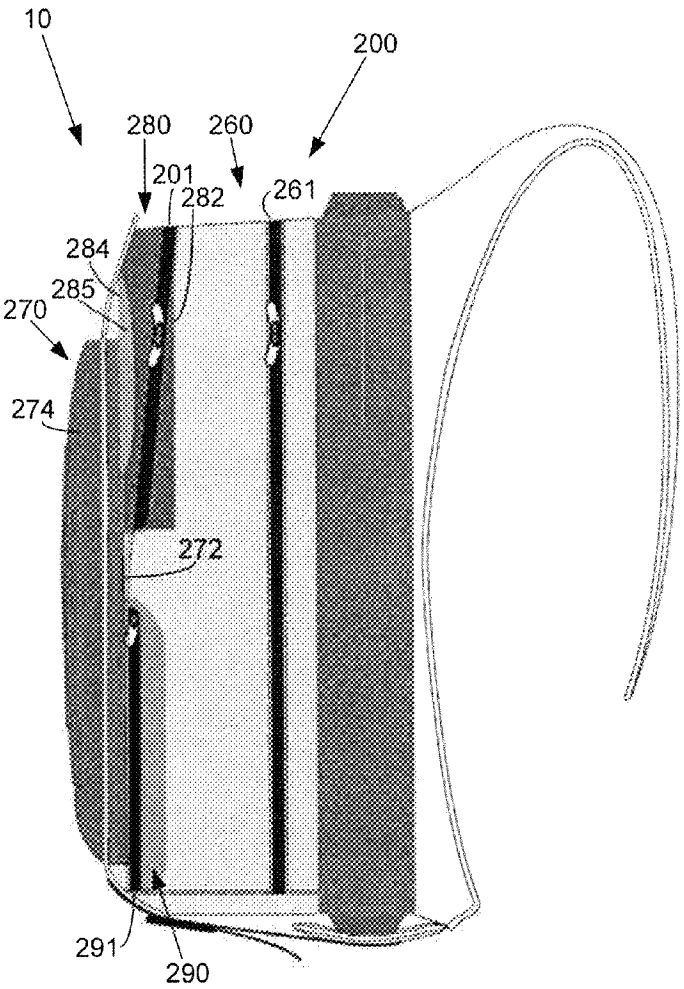

In various embodiments, the second compartment 60 may include a plurality of compartments. In some embodiments, for example as shown in FIGS. 9A-9B, the backpack 10 includes (but is not limited to) a main compartment 260 (which may correspond to the second compartment 60), a front compartment 270, an organizer pocket 280, a top pocket 285, a side pocket 290, and a water bottle pocket 295.

Figure 10F:
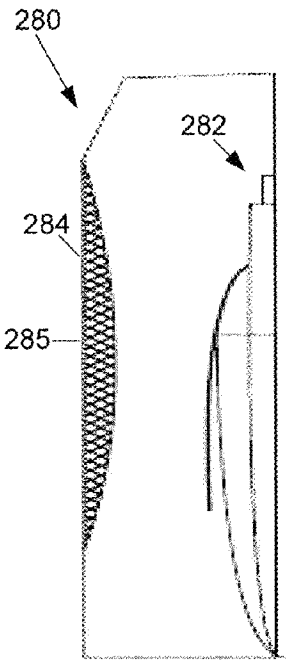
Figure 10E:
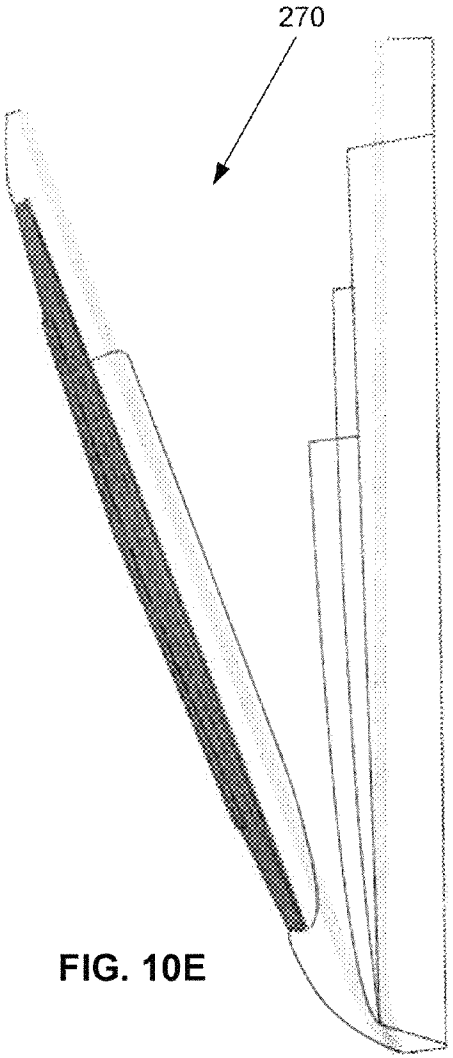

In various embodiments, one or more of the compartments may include organizers or the like. It should be noted that the compartments noted are merely illustrative and that one or more of the organizers may be implemented in any compartment. For example, as shown in FIGS. 10A and 10F, the organizer pocket 280 (e.g., FIGS. 9A-9B) may include an organizer 282 on a rear wall of the organizer pocket 280. The organizer 282 may include (but is not limited to) pencil pockets 282*a*, a flap pocket 282*b*, a mesh pocket 282*c*, a zipper pocket 282*d*, a slash pocket 282*e* (e.g., for business cards), additional pockets within the zipper pocket, and/or the like. As another example, as shown in FIG. 10C, the front compartment 270 (e.g., FIGS. 9A-9B) may include an organizer 272 on a rear wall of the front compartment 270. The organizer 272 may include (but is not limited to) a slash pocket 272*a*, a file pocket 272*b*, a slash pocket 272*c*, a power cord pocket 272*d*, a pleated pocket 272*e*, and/or the like. As shown in FIG. 10D, the front compartment 270 may include an organizer 274 on a front wall of the front compartment 270. The organizer 274 may include (but is not limited to) a zipper pocket 274*a*, a tablet pocket 274*b* (for receiving a tablet or the like) with padding, and/or the like.

In some embodiments, one or more of the compartments may be configured to allow viewing of the contents provided within. For example as shown in FIGS. 10B and 10F, the organizer pocket 280 includes a mesh panel 284 to allow the contents of the organizer pocket 280 to be viewable.

Figure 12B:
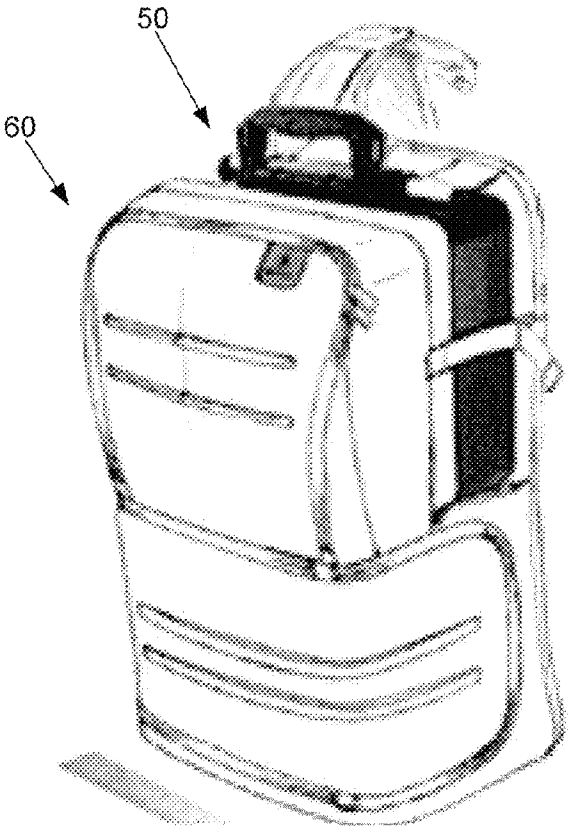
FIG. 12B illustrates a carrying case according to various embodiments of the disclosure.
Figure 12A:
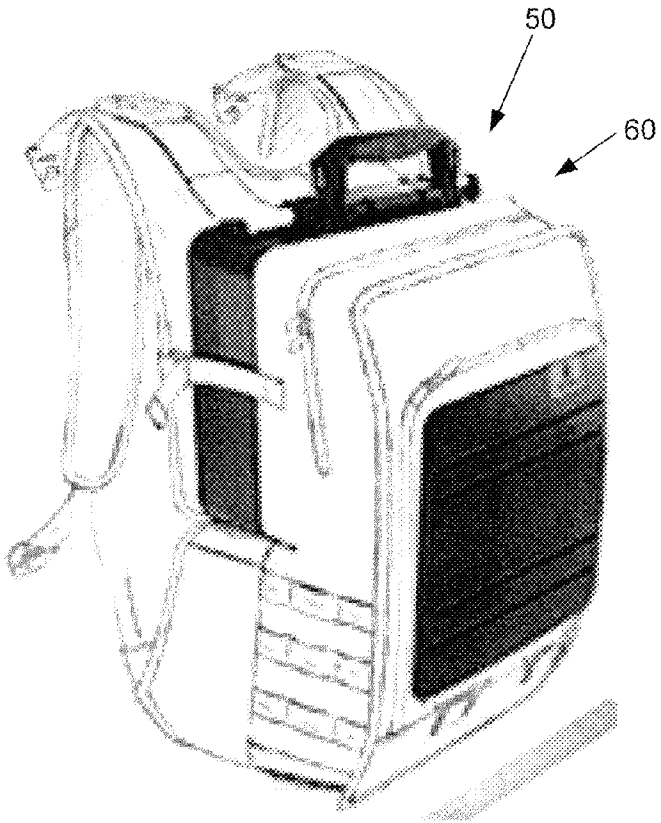
FIG. 12A illustrates a carrying case according to various embodiments of the disclosure.

In various embodiments, the first compartment 50 and the second compartment 60 each extend along a length dimension of the backpack 10. In other embodiments, for example as shown in FIGS. 12A and 12B, one or more of the first compartment 50 and the second compartment 60 extend along only a portion of the length dimension of the backpack 10.

Figure 13:
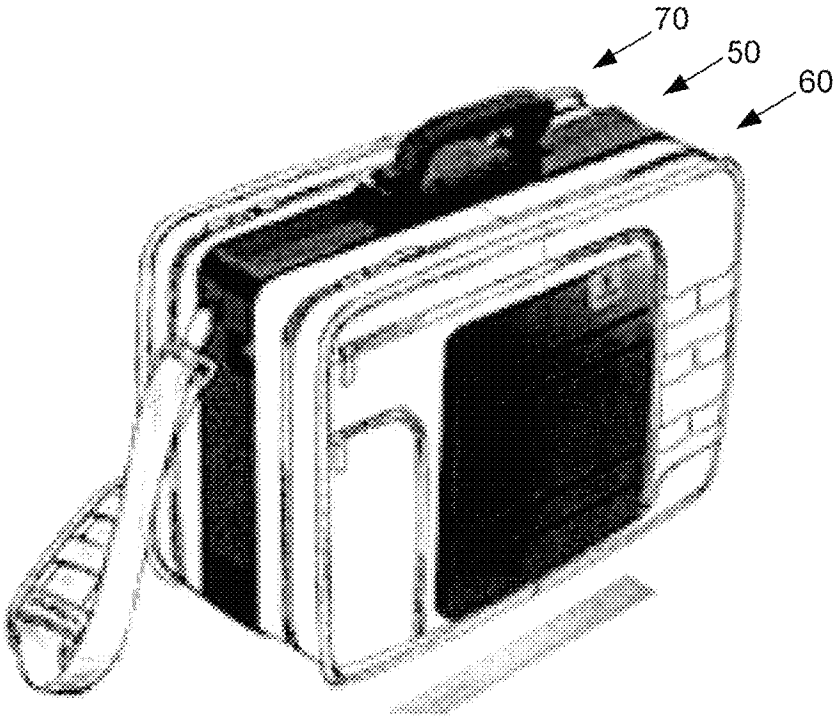
FIG. 13 illustrates a carrying case according to various embodiments of the disclosure.

In some embodiments, for example as shown in FIG. 13, the soft rear shell 100 may comprise a third compartment 70. Accordingly, first compartment 50 is arranged between the second compartment 60 and the third compartment 70.

Figure 14B:
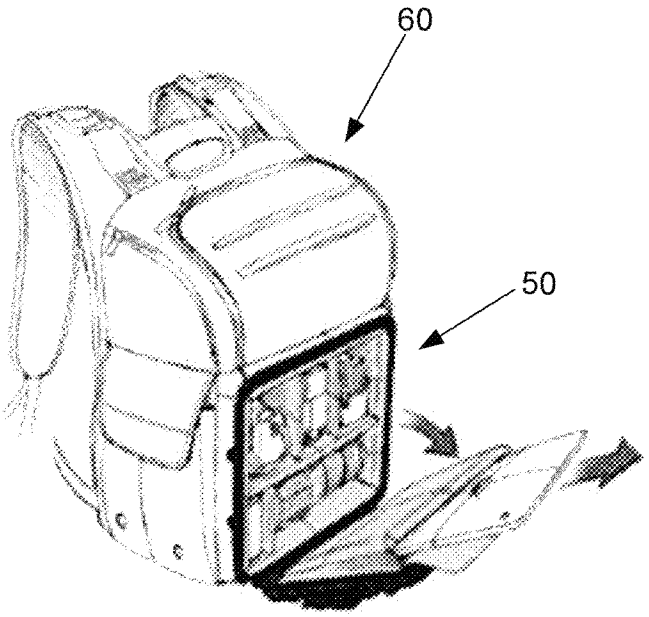
FIG. 14B illustrates a carrying case according to various embodiments of the disclosure.
Figure 14A:
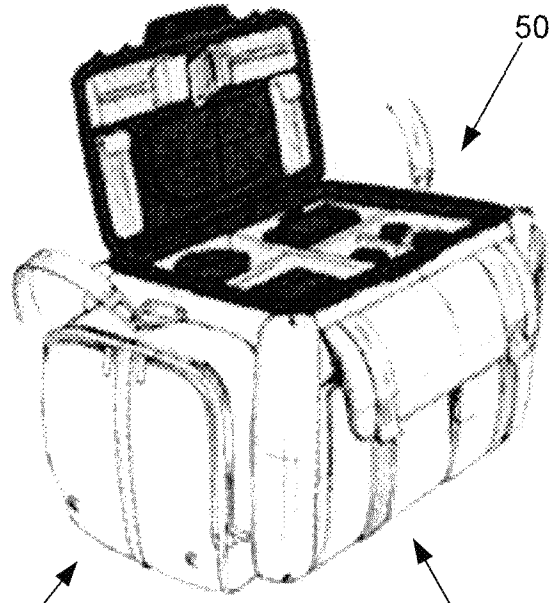
FIG. 14A illustrates a carrying case according to various embodiments of the disclosure.

In some embodiments, the first compartment 50 is arranged to be substantially parallel with the second compartment 60 while the backpack 10 is carried. However, the first compartment 50 may be arranged relative to the second compartment in any suitable manner. For instance, in some embodiments, for example as shown in FIG. 14A, the first compartment 50 is arranged above and/or between several compartments. In some embodiments, for example as shown in FIG. 14B, the first compartment is arranged beneath the second compartment 60.

Various embodiments are directed to a backpack-type configuration. However, any type of carrier may be used including (but not limited to) a suitcase, luggage, camera carrying case, duffel bag, and/or the like.

The previous description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

What is claimed is:

1. A method of manufacturing a carrying case, the method comprising:

providing a first compartment made of a rigid material, the first compartment defining an interior volume, the first compartment comprising a first shell member and a second shell member; and providing a second compartment coupled to the first compartment, the second compartment made of a flexible material, the second compartment defining an interior volume that is separate from the interior volume of the first compartment, the second compartment comprising a soft front shell attached to the second shell member;

providing a soft rear shell attached to the first shell member, the soft rear shell forming a recess;

providing a carrying member;

arranging the first compartment between the soft front shell and the soft rear shell, wherein the recess is configured to receive at least a portion of the first compartment, and the soft rear shell comprises at least one support strap, at least a portion of each of the at least one support strap is arranged within the recess, the at least one support strap is configured to couple the soft rear shell to the first shell member, the at least one support strap couples to a frame between the soft rear shell and the first shell member.

2. A carrying case, comprising:

a first compartment made of a rigid material, the first compartment defining an interior volume, the first compartment comprising a first shell member and a second shell member;

a second compartment coupled to the first compartment, the second compartment made of a flexible material, the second compartment defining an interior volume that is separate from the interior volume of the first compartment, the second compartment comprising a soft front shell attached to the second shell member;

a soft rear shell attached to the first shell member, the soft rear shell forming a recess; and a carrying member, wherein the first compartment is arranged between the soft front shell and the soft rear shell, the recess is between the first shell member and the carrying member, the recess is configured to receive at least a portion of the first compartment, and the soft rear shell comprises at least one support strap, at least a portion of each of the at least one support strap is arranged within the recess, the at least one support strap is configured to couple the soft rear shell to the first shell member, wherein the at least one support strap couples to a frame between the soft rear shell and the first shell member.

3. The carrying case of claim 2, wherein the carrying member is not directly secured to the first shell member.

4. The carrying case of claim 2, wherein each of a first end and a second end of the carrying member are coupled to the first shell member by directly coupling to the soft rear shell, which is coupled to the first shell member.

5. The carrying case of claim 2, wherein a first end and a second end of the carrying member is coupled to the first shell member via a surface of the soft rear shell, the surface is external to the recess.

6. The carrying case of claim 2, wherein the recess define one or more walls and having an opening facing a first direction, the one or more walls of the recess enclose at least a portion of every face of the first compartment except a face facing the first direction.

7. The carrying case of claim 2, wherein the soft rear shell forms a shape of the recess without the first compartment being received in the recess.

8. The carrying case of claim 2, wherein the soft rear shell comprises a hatch configured to provide an opening to the frame.

9. The carrying case of claim 2, wherein the frame is configured to allow the first shell member to tilt with a user of the carrying case by providing a pivot action.

10. The carrying case of claim 2, wherein the soft rear shell comprises a lumbar support coupled to the first compartment.

* * * * *